United States Patent [19]

Da Costa

[11] Patent Number: 5,039,287

[45] Date of Patent: Aug. 13, 1991

[54] DIRECT SUCTION SYSTEM FOR A HERMETIC ROTARY COMPRESSOR WITH INSULATING MATERIAL AT INTAKE CONDUIT

[75] Inventor: Caio M. F. N. Da Costa, Joinville, Brazil

[73] Assignee: Empresa Brasileira de Compressores S/A-Embraco, Joinville, Brazil

[21] Appl. No.: 402,040

[22] Filed: Sep. 1, 1989

[30] Foreign Application Priority Data

Sep. 6, 1988 [BR] Brazil ..... 8804677

[51] Int. Cl.[5] ..... F04C 29/00

[52] U.S. Cl. ..... 418/63; 417/902; 418/181

[58] Field of Search ..... 418/47, 181, 63, 83; 417/902, 313

[56] References Cited

U.S. PATENT DOCUMENTS

| | | | |
|---|---|---|---|
| 3,209,991 | 10/1965 | Sauber | 417/902 |
| 4,164,384 | 8/1979 | Hertell | 418/417 |
| 4,648,811 | 3/1987 | Tahata et al. | 417/902 |
| 4,815,947 | 3/1989 | Okoma et al. | 417/902 |
| 4,844,705 | 7/1989 | Gannaway | 417/313 |

FOREIGN PATENT DOCUMENTS

| | | | |
|---|---|---|---|
| 217785 | 12/1983 | Japan | 417/902 |
| 1793 | 1/1988 | Japan | 417/902 |
| 68791 | 3/1988 | Japan | 417/902 |

*Primary Examiner*—Leonard E. Smith
*Assistant Examiner*—D. L. Cavanaugh
*Attorney, Agent, or Firm*—Darby & Darby

[57] ABSTRACT

A compressor in which the portion of the suction tube within the housing is rectilinear with a constant diameter and has an internal or external insulating tube, the suction tube being arranged through a positioning socket which is attached to the front cover of the compressor housing and extends inside and outside the housing with the positioning socket outer end being welded around the suction tube at a point away from the housing front cover and from the insulating tube inlet end within the compressor housing.

11 Claims, 2 Drawing Sheets

DIRECT SUCTION SYSTEM FOR A HERMETIC ROTARY COMPRESSOR WITH INSULATING MATERIAL AT INTAKE CONDUIT

BACKGROUND OF THE INVENTION

This invention relates to a hermetic rotary compressor and more particularly to a direct suction system of refrigerant gas into the compressor cylinder and to the assembly process of said suction system.

The gas suction into the high side of rotary compressors is accomplished through a suction tube made of metallic material. When operating, such tube is heated both by gas and oil under high pressure and temperature inside the compressor housing and also by conduction through the parts of the compressor assembly which are under high temperature.

This suction tube heating will in turn cause the heating of the suction gas. Effectively, under usual operation, the difference in the suction gas temperature between the portion of the tube outside the housing and the portion of the tube immediately before the compressor cylinder is about 40° C.

This increase in the temperature reduces the gas specific volume and therefore the filling of the cylinder during each suction cycle, thereby causing a decrease in the compressor capacity. This effect is known in the literature as suction super heating loss.

The conventionally known configuration for the suction system for hermetic compressors, and particularly those of the horizontal rolling piston type, is a metal tube connecting the outside of the housing through its front cover to the compressor components through the wall of the sub-bearing and then through a knee shaped hole which is formed in the cylinder to the inner side of the suction volume portion of the compressor. In addition, there is between the front cover of the housing and the wall of the sub-bearing a portion with a widened diameter which houses a screen which is used to prevent foreign particles from entering inside the compressor set components.

In the conventional compressor configuration there is no attempt made to reduce the suction superheating problem. When the screen is placed into the central widened portion of the tube the problem is increased since the heat transfer surface is increased both in length and in diameter. In addition, the gas flowing through the screen acts as an excellent heat exchange means.

BRIEF DESCRIPTION OF THE INVENTION

The object of this invention is to provide a suction system avoiding the suction superheating drawbacks as well as keeping the suction flow in a straightmost way without obstacles while being easy to assemble and being of low cost.

The suction system of the invention is applied to a hermetic rotary compressor including a hermetic sealed housing shell having an end front cover and having a cylinder mounted therein. A rolling piston assembly is mounted to a shaft which is driven by an electric motor, the shaft having an end supported by bearings which are attached to the cylinder. A suction tube is provided inside an oblong tubular socket which is attached through the front cover of the housing and has its outer end welded around the suction tube which communicates with the cylinder suction volume through a passageway provided in the tube.

According to this invention, the portion of the suction tube which is inside the housing is linear and its diameter is substantially constant. The linear portion of the tube is covered by a tube of insulating material having a first end placed at the suction passageway of the cylinder and the second end near the inner face of front cover of the housing.

The system being constructed in the above mentioned manner allows a minimum increase in the suction gas temperature and, therefore, a better filling of the cylinder at each cycle which results in a greater compressor volumetric capacity.

According to a preferred embodiment of the invention, the widened portion of the suction tube in which the screen is to be housed is placed outside of the housing shell. However, according to another embodiment using a tube of insulating material inside the suction tube, the screen is mounted inside the insulating tube which has a split construction.

The new constructive arrangement may be associated to a new process for the suction system assembly. Taking the hermetic rotary compressor and the suction system thereof as above defined into consideration, the assembly process of the latter includes the steps of locating the socket through the housing front cover and welding the socket to the inner and outer faces of the front cover. The cylinder, piston and electric motor are mounted inside the closed housing shell, and the elements of the suction tube assembly and the insulating material tube are introduced through the socket and are attached by an interference fit between the inner end of an aperture in the wall of the sub bearing or the cylinder. Thereafter, the outer end of the socket is welded around the suction tube.

In the event the insulating material tube is to be internal to the suction tube, the latter is introduced through the support with the insulating tube already assembled in the tube.

In the event the insulating tube is provided outside the suction tube, the insulating tube is first introduced through the socket and fitted into an aperture provided in the wall of the sub bearing or the cylinder. Then, the suction tube is installed in the socket and fit into the insulating tube.

The construction of the invention together with the assembly process allows that the refrigerant fluid flow is properly insulated returning to the compressor suction side by means of members being easy to pre-manufacture and assemble. Also, the weld area between the socket and the suction tube is placed away from the insulating tube, preferably made of plastic material, far enough to avoid the latter, from being affected.

BRIEF DESCRIPTION OF THE DRAWINGS

The invention will hereinafter be described with reference to the annexed drawings, in which.

DETAILED DESCRIPTION OF THE INVENTION

Figure 1:
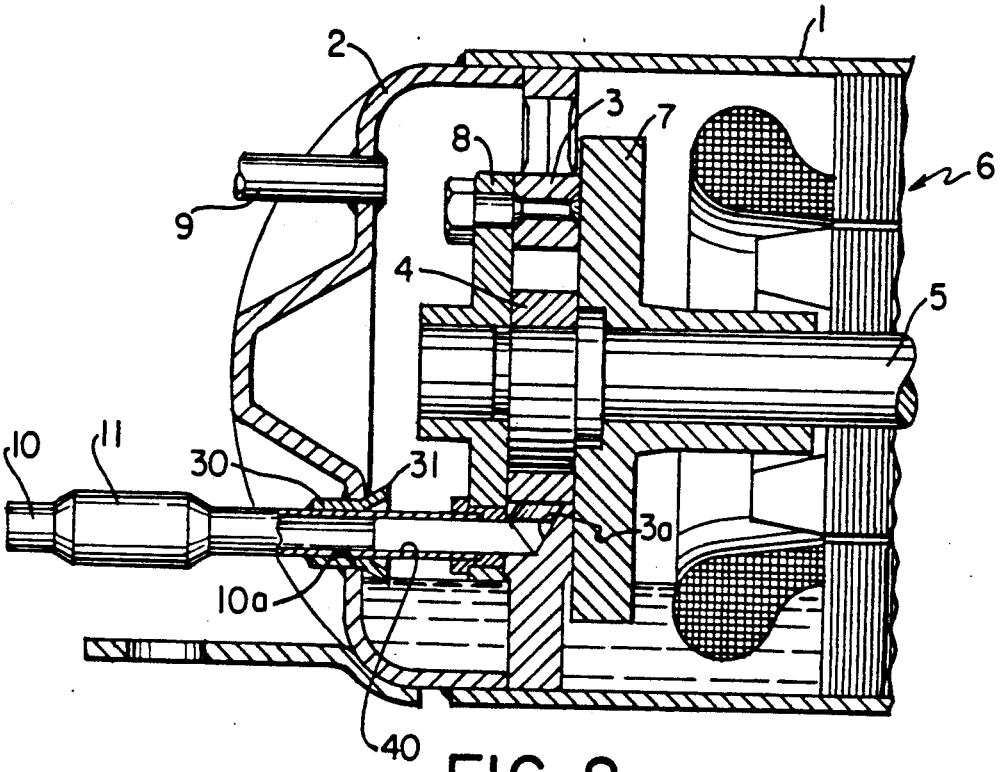
FIG. 1 is a longitudinal section view of the hermetic rotary compressor having the direct suction system.

The suction system as illustrated in FIG. 1, is applied to a hermetic rotary compressor including a hermetic housing shell 1 having a front end cover 2. Mounted within the housing is a cylinder assembly 3. A rolling piston 4 is provided which rotates within the cylinders. Piston 4 is eccentric and is mounted to a shaft 5 which is driven by an electric motor 6 mounted in the housing. The end of the shaft 5 carrying the piston 4 is supported by a main bearing 7 and a sub bearing 8 which are fastened to opposite sides of the cylinder.

Figure 2:
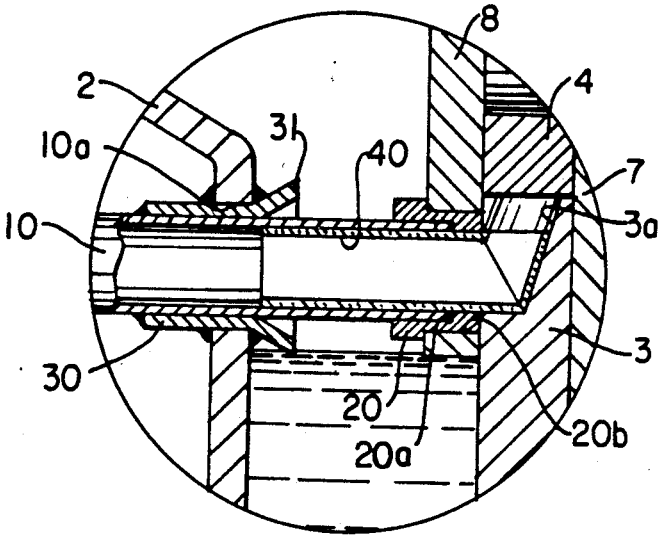
FIG. 2 shows an enlarged detail of the portion of FIG. 1 having the new suction tube according to a preferred embodiment of the invention wherein the insulating tube is provided inside the suction tube.

The front cover 2 is provided with a discharge tube 9 and an opening 10*a* for passage of a suction tube 10. The suction tube 10, as illustrated in the embodiment of FIGS. 1 and 2, is a metal tube which passes through the front cover 2 and its inner end is attached by an interference fit into a shoulder 20*a* surrounding a through axial hole in an engagement plug 20. Plug 20 is attached to an axial hole 20*b* in the wall of the sub bearing 8 and has its inner end in fluid communication with an angular knee shaped passageway 3*a* provided in the cylinder 3 to communicate with the cylinder chamber and piston 4.

Although the plug 20 is shown as being provided on the wall of the sub bearing 8, it should be understood that the suction tube 10 can have its inner end fitted directly into the cylinder wall 3 or by use of a fitting such as for example plug 20.

The portion of tube 10 within the housing 1 is linear and constant in diameter. The portion located outside the housing is provided with an enlarged coupling 11 to house the screen protecting the suction against foreign particles.

To attach the suction tube 10 to the housing 1, a tubular socket 30 is provided in cover 2 having an axial extension outside of the housing cover and the end within the housing 1 being provided with a frustum shaped entry mouth 31. In the embodiment as illustrated in FIGS. 1 and 2, the suction tube positioning socket 30 has an inner diameter slightly greater than the outer diameter of the suction tube 10.

The portion of the suction tube 10 within the housing has an internal insulating tube 40, the end portion of which is provided with a lateral opening 40*a* which is fitted into the knee shaped portion of the cylinder passageway 3*a*. The insulating tube is preferably of a suitable thermoplastic material. The length of the insulating tube 40 is designed so that its end at the cover 2 is located on a plane which is transverse and tangent to the start of the frustum shaped mouth widening 31 in the positioning socket 30. Thus there is no area of direct heat transfer from the socket 20 to the insulating tube.

In such an arrangement, the positioning socket 30 can first be welded to the inner and outer faces of the front cover 2 of the housing 1. Then, the front cover 2 can be welded to the housing 1 which already has mounted therein the members of the compressor set which are to be enclosed in the housing. After the front cover 2 has been welded, the suction tube 10 is provided with the internal insulating tube 40 and then it is put into the positioning socket 30 until the suction tube 10 outlet end is fitted into the plug 20 on the sub bearing 8 of the cylinder 3. The end of the insulating tube 40 is inserted into the radial passage 3*a*. Then, the outer end of the positioning socket 30 is welded around the suction tube 10 at 11.

The construction of the embodiment of FIGS. 1 and 2 together with the assembly method above described allows than an inner insulating coating is obtained all through the extension of the suction tube 10 which is located within the housing, without melting or damaging in any way the insulating tube 40 when the positioning socket 30 is welded to the suction tube 10. It will be appreciated that the socket tube welding point is properly away from the insulating tube 40 input end.

Figure 2A:
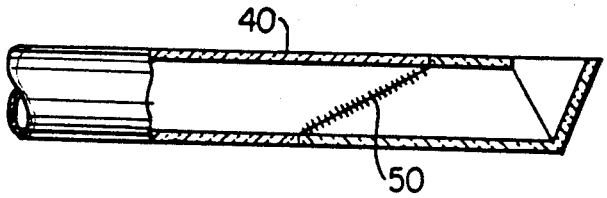
FIGS. 2*a* and 2*b* show in longitudinal section two different and additional embodiments for forming the insulating tube in FIG. 2 so that said tube is able to receive a suction protecting screen.
Figure 2B:
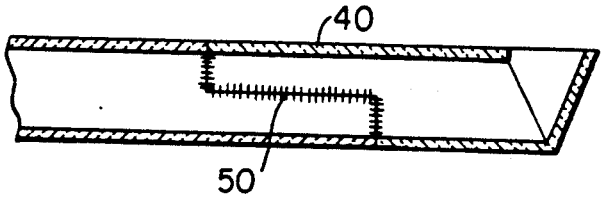

FIGS. 2*a* and 2*b* illustrate a variation of the construction as illustrated in FIG. 1 in order that the protecting screen 50 can be mounted directly within the insulating tube 40. In this embodiment, the insulating tube 40 is split in such a way that the screen is welded or attached within the two tube sections and forms only one member with the insulating tube. As illustrated in the examples of FIGS. 2*a* and 2*b*, the screen 50 should have such a surface that can minimize load losses to the refrigerant fluid flow passing through it.

In FIG. 2*a*, the screen 50 is mounted within the tube 40 diagonally across its inner diameter and attached against movement by tabs 51 which extend through the tube wall. The screen is cut to a configuration so that it spans the entire inner diameter. In FIG. 2*b*, the screen 50 is bent with a central section 50*a* extending along the length of the tube held between two shorter end sections 50*b* which are connected by the tabs 51 to diametrically opposite points on the tube wall. The central section 50*a* extends across the diameter of the tube. After the screen is inserted into the tube 40 in both embodiments of FIGS. 2*a* and 2*b*, the tube is sealed.

Figure 3:
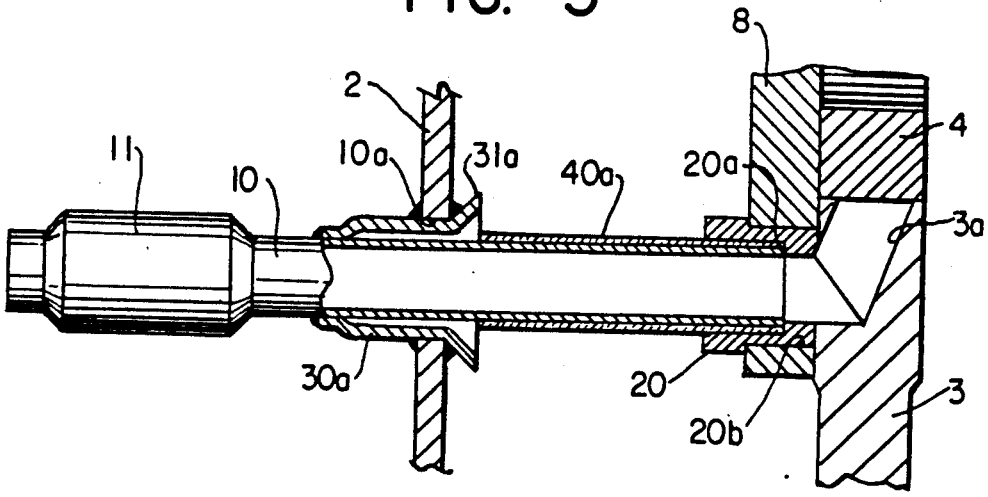
FIG. 3 is a view similar to that of FIG. 2 showing another embodiment of the invention, wherein the insulating tube is provided outside the suction tube.

A further embodiment is illustrated in FIG. 3 where the insulating tube 40*a* is arranged on the outside of the suction tube 10. In this case, the inner diameter of the positioning socket 30*a* is made slightly greater than the outer diameter of the insulating tube 40*a*.

The assembly method for the embodiment of FIG. 3 is basically that used for mounting the suction assembly as illustrated in FIGS. 1 and 2. The only change is that the insulating tube 40*a* has to be put into the positioning socket 30*a* immediately before the suction tube 10 is installed and the positioning socket outer end 30*a* has to be deformed to insert the suction tube before the final welding is made between such socket end 30*a* and the suction tube 10. As it will be appreciated from FIG. 3, the input end of the outer insulating tube 40*a* is located on a transverse plane which is tangent to the mouth of the frustrum widening of the positioning socket 30*a* so that the insulating tube 40*a* does not touch the positioning socket thereby avoiding the melting of the latter when the suction socket tube is welded to cover plate 2.

Although this invention has been described and illustrated in connection with several preferred configurations, it is possible to be modified without departing from the inventive concept thereof as defined by the claims that follow:

What is claimed is:

1. A direct suction system for a hermetic rotary compressor comprising:

a hermetic housing shell having an end cover, a cylinder within the housing, said cylinder having a passageway to the portion forming the cylinder suction volume, a rolling piston mounted to a shaft driven by an electric motor for rotation within the cylinder, a main and a sub bearing attached to the opposite sides of the cylinder within which the shaft rotates, one of said bearings being adjacent to the part of the cylinder having the passageway and having an opening in communication with said cylinder passageway, a tubular socket mounted on the cover the end of the socket within the housing having a widened mouth, a suction tube of smaller diameter than the socket widened mouth extending through said tubular socket for interconnecting the source gas from outside of the housing to the cylinder suction volume through the cylinder suction passageway, the portion of the suction tube within the housing being rectilinear with a substantially constant diameter and having an end terminating before reaching said cylinder, and a tube of insulating material within the portion of the suction tube within the housing, the inlet end of the insulating tube beginning within the socket at a point at or after where the mouth begins to widen, the outlet end of the insulating tube extending beyond the terminating end of the suction tube and extending into the cylinder suction passageway.

2. A direct suction system according to claim 1, wherein the suction tube has a widened section outside the housing for housing a protection screen.

3. A direct suction system according to claim 1 wherein a protection screen is located within the insulating tube portion within the housing.

4. A direct suction system according to claim 1, wherein the insulating tube is around the outside of the entire length of the rectilinear portion of the suction tube within the housing and has an end which is in the bearing opening.

5. A direct suction system according to claim 4, wherein the inner diameter of the positioning socket is slightly greater than the outer diameter of the insulating tube.

6. A direct suction system for a hermetic compressor as in claim 1, wherein the cylinder passageway extends at an angle toward said piston.

7. A direct suction system for a hermetic compressor as in claim 6 where the outlet end of the insulating tube has an angled outlet corresponding to the angle of the cylinder passageway.

8. A direct suction system for a hermetic rotary compressor comprising:

a hermetic housing shell having an end cover, a cylinder within the housing, said cylinder having a passageway to the portion forming the cylinder suction volume, a rolling piston mounted to a shaft driven by an electric motor for rotation within the cylinder, a main and a sub bearing attached to opposite sides of the cylinder within which the shaft rotates, one of said bearings having an opening communicating with said cylinder passageway, a tubular socket mounted on the cover, a suction tube extending through said tubular socket to supply the source gas from outside of the housing to the cylinder suction volume through the cylinder suction passageway, the portion of the suction tube within the housing being rectilinear with a substantially constant diameter, a tube of insulating material within the portion of the suction tube within the housing, the outlet end of the insulating tube extending beyond the terminating end of the suction tube and extending into the cylinder suction passageway and the input end starting near the inner face of the front cover, and a filter within said tube of insulating material which is within the housing.

9. A direct suction system according to claim 8 wherein said tube of insulating material is split with the filter being inserted through the split.

10. A direct suction system according to claim 9 wherein said filter is placed diagonally along the length of the insulating tube.

11. A direct suction system according to claim 10, wherein said filter element has a main portion which extends generally along the length of the insulating tube and a portion at each end of the main portion which is generally transversed to the insulating tube length.

* * * * *